United States Patent [19]

Koslowski

[11] 4,401,429

[45] Aug. 30, 1983

[54] SELF-EMPTYING SOLID BOWL CENTRIFUGE

[75] Inventor: Karl Koslowski, Hamminkeln, Fed. Rep. of Germany

[73] Assignee: Klöckner-Humboldt-Deutz AG, Fed. Rep. of Germany

[21] Appl. No.: 238,551

[22] Filed: Feb. 26, 1981

[30] Foreign Application Priority Data

Mar. 13, 1980 [DE] Fed. Rep. of Germany ..... 3009669

[51] Int. Cl.[3] ..... B04B 11/00

[52] U.S. Cl. ..... 494/30; 494/40; 251/63.6

[58] Field of Search ..... 233/7, 19 R, 19 A, 20 R, 233/20 A, 21, 22, 27, 28, 46, 47 R, 1 E; 91/404, 410, 403; 251/63.5, 63.6

[56] References Cited

U.S. PATENT DOCUMENTS

| | | | |
|---|---|---|---|
| 2,087,727 | 7/1937 | Bath | 233/20 A |
| 2,106,688 | 1/1938 | Bath | 233/20 A |
| 2,853,057 | 9/1958 | McAuley | 91/403 X |
| 2,955,754 | 10/1960 | Nyrop | 233/20 R |
| 3,167,509 | 1/1965 | Steinacker | 233/19 A |
| 3,299,832 | 1/1967 | Milne | 251/63.6 X |
| 3,408,001 | 10/1968 | Nilsson | 233/19 R |
| 3,630,431 | 12/1971 | Oka et al. | 233/20 A |
| 4,015,773 | 4/1977 | Thylefors | 233/20 A |
| 4,160,521 | 7/1979 | Lindgren | 233/27 |
| 4,191,498 | 3/1980 | Weirich et al. | 91/404 X |

*Primary Examiner*—Harvey C. Hornsby
*Assistant Examiner*—Christine A. Peterson
*Attorney, Agent, or Firm*—Hill, Van Santen, Steadman & Simpson

[57] ABSTRACT

A solid bowl centrifuge for separating substances of varying densities particularly for separating solid liquid mixtures having a self-emptying feature where the heavier material is discharged through an annular gap, the size of which is controlled by an annular slide valve separated by a pressure chamber and spring biasing means with the pressure chamber operative to close the valve and capable or rapid movements of the valve and moving the valve to a predetermined position by virtue of control valves and a measuring or dosing valve for the hydraulic fluid delivered to the pressure chamber.

14 Claims, 1 Drawing Figure

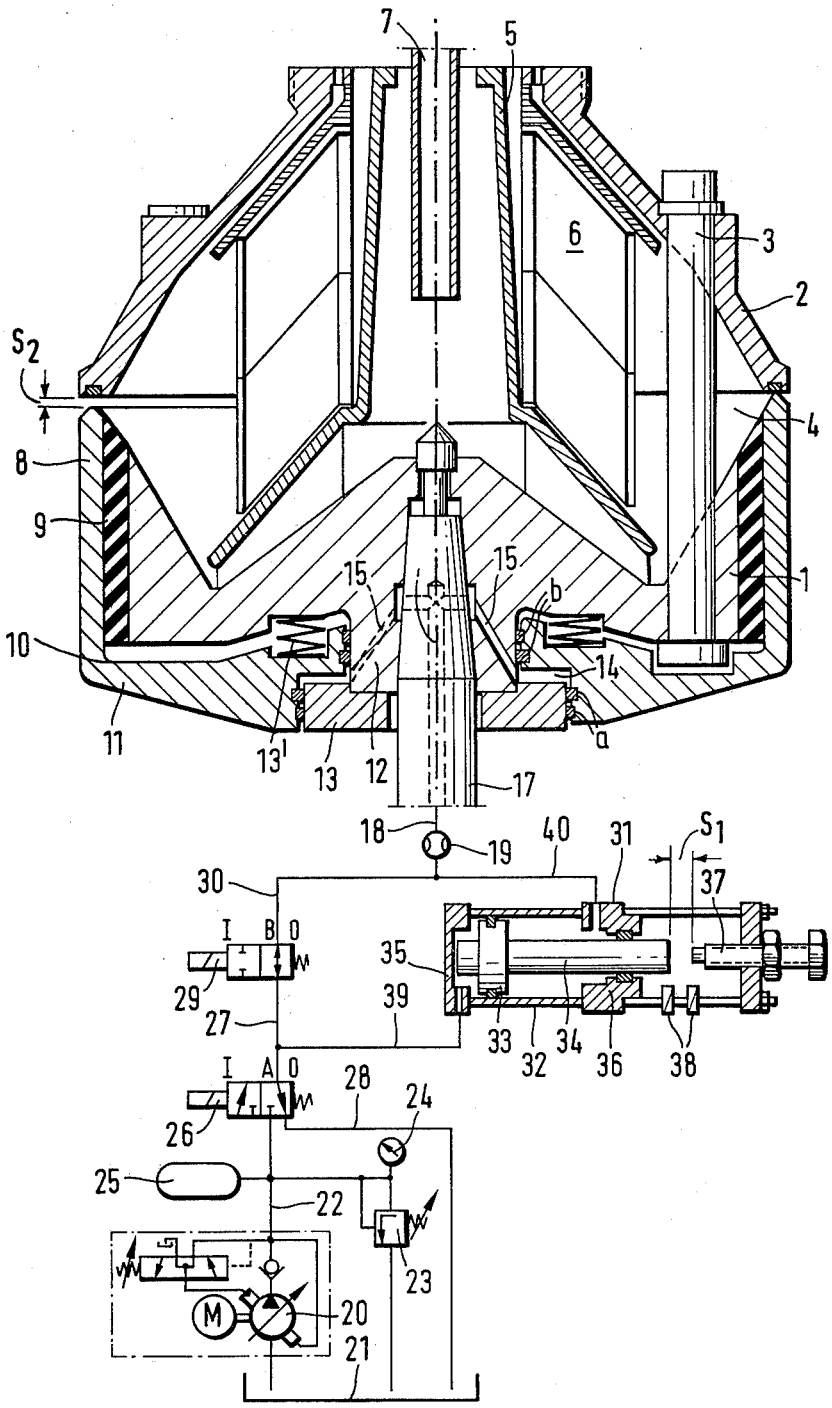
7
5
6
3
2
S2
4
8
9
1
15
15
b
10
14
11
13'
13
12
a
17
18
19
40
31
S1
37
30
I B O
35
29
39
27
33
32
34
36
38
I A O
28
24
26
25
22
23
M
20
21

SELF-EMPTYING SOLID BOWL CENTRIFUGE

BACKGROUND OF THE INVENTION

The invention relates to improvements in centrifuges, and more particularly to a self-discharging centrifuge for the separating of materials of different densities such as solid liquid mixtures wherein the separating vessel discharges the separated heavy materials through an annular gap, the size of which is controlled by a slide valve which moves axially to control the size of the gap, and the improvement resides in the arrangement of the centrifuge and particularly in the slide valve structure and the control therefor.

A form of self-discharging solid jacket centrifuge is shown and described in U.S. Pat. No. 3,823,868. In this structure a separator vessel is provided rotatable about its central axis and an axially movable or sliding circular valve is moved back and forth to control the size of an annular discharge gap which opens from the separating vessel and releases the heavy materials which have been separated. In U.S. Pat. No. 3,823,868, a circular slide valve is urged toward closed position by a spring. To open the gap and increase its size, liquid is introduced into a pressure chamber which is open to the outside. The sliding circular valve is moved against the spring power of the spring element in the opening direction and thereby opens the outlet gap. The pressure chamber of the structure of this patent has nozzle shaped radially extending openings through which the liquid can escape out of the pressure chamber. This arrangement provides disadvantages in that the sliding circular valve can be moved only during operation of the centrifuge against the force of the spring to open the gap. An arrangement may be provided wherein the spring urges the gap toward open position and the pressure chamber closes the gap, but in either arrangement when the separator is at a standstill and is not rotating, the gap is held either in a closed or open position. This results that if the rotation of the separator stops, the centrifuge drum is therefore either unintentionally emptied or remains filled. Further, no function monitoring of the sliding circular valve at standstill of the centrifuge is possible.

Further, in this prior art structure of U.S. Pat. No. 3,823,868, because the pressure chamber is open to atmospheric pressure, and it depends on the slow release of liquid through the radial openings in the wall from the pressure chamber, opening and closing of the outlet gap cannot be accomplished speedily and movements or change in opening is significantly retarded. This has a disadvantageous effect on the discharge of the separated substances out of the centrifuge vessel.

Also, in accordance with this prior structure, the movement cycle in the position of the sliding circular valve and the width of the outlet gap cannot be monitored. The operator will never know precisely when the outlet gap is entirely opened or whether it is closed or when it is closed by the sliding circular valve. The movement of the sliding circular valve and the opening and closing of the outlet gap is dependent not only on the rotation or operating state of the centrifuge but also on the solid liquid mixture which is located in the vessel and the pressure of this liquid which is generated by the centrifugal force, and therefore the opening gap can be controlled only with great difficulty, but cannot be controlled at all when the structure is not rotating.

In German Pat. No. 294,381, a centrifuge structure is disclosed whereby the sliding circular valve which lies outside can be moved in a closing and opening direction with the help of several twin piston cylinder units which are arranged in the floor of the separating vessel. This device for the movement of the sliding circular valve is complicated and expensive.

An object of the invention is to provide a device which makes possible a rapidly operating continuously adjustable valve displacement which is independent of the operating state of the separator.

A further object of the invention is to provide a separator with a controllable discharge valve arrangement which provides advantages and objectives and accomplishes an improved separating function avoiding disadvantages present in the prior art.

A feature of the invention is to provide a control for an annular slide valve for a separator where the control operates by a pressure chamber operative to move the valve in a closing direction and the pressure chamber is supplied with pressurized fluid to align with a control device positioned outside of the centrifuge with the control device controlling the inlet to the pressure chamber and/or the outlet of the fluid from the pressure chamber thereby controlling the closing and opening of the sliding circular valve. The invention further employs a spring means biasing the valve in a direction opposite the action of the pressure chamber.

In accordance with a preferred form of the invention, the sliding circular valve is moved by the pressure medium in the pressure chamber only in the closing direction while movement of the valve in the opening direction is accomplished by a spring biasing means. Because of this arrangement, the movement of the sliding circular valve and thus the opening and closing of the outlet gap, can be accomplished in a short time on the order of less than 0.1 seconds.

Further, in accordance with the preferred arrangement of the invention, the closing force and therefore the contact pressure of the sealing edge of the sliding circular valve can be varied or controlled and optimumly adjusted for each operating state. This makes possible the adjustment of the closing force of the sliding circular valve in such a manner that in the event of a predetermined filling of the separating vessel, the opening pressure due to the material can create a self-acting discharge and overloading of the centrifuge drum is avoided. Further, control can be effected on the discharge valve completely independently of the operating state of the separator, and the annular gap can be adjusted larger or smaller as needed. This makes possible an increase or decrease in the discharge of heavy material which is separated in the centrifuge drum and makes possible an optimum accommodation to the substances, that is, the solid liquid mixtures which are to be separated in the centrifuge and permits accommodating them to engineering requirements of coacting ancillary systems.

In a preferred form of the invention, the pressure chamber is arranged in the central region lying close to the axis of rotation of the separator and located between the floor of the sliding cylindrical valve and the floor of the separating vessel. With this construction, the pressure chamber can be dimensioned relatively small so that is effectiveness is more favorable, and a quick closing and a quick opening of the gap can be accomplished. A pressure chamber of this design has the advantages which are required by an operation where control is essential and makes it capable to move only very small quantities of pressure medium with a resultant attainment of quick movement of the sliding cylindrical valve.

In a further arrangement of the preferred embodiment, the control device includes a pilot valve which is arranged in the fluid pressure supply line, and also includes a volume control element for the pressure medium which is operative in connection with the pilot valve. With the aid of these elements, the movement of the sliding cylindrical valve and hence the opening and closing of the gap from the separation vessel can be carried out in a uniquely simple and economical manner.

The volume control element consists of a double acting piston and cylinder unit with a piston rod on one side which operates cooperatively with an adjustable stop. Using this stop, the width of the outlet orifice which is required or desired in each case can be precisely adjusted.

Further in accordance with the preferred arrangement, in the cylinder wall of the double operating piston and cylinder unit there is arranged an end position scanner or measuring device for the piston rod. With the help of this end position measure or caliper, both the width of the outlet gap can be determined and the opening and closing movement of the sliding valve can be monitored.

Other objects, advantages and features will become more apparent with the further teachings of the principles of the invention in connection with the disclosure of the preferred embodiments described and shown in the specification, claims and drawings, in which:

DRAWINGS

The single FIGURE of the drawing is primarily a somewhat schematic vertical sectional view taken through a separator showing the mechanism and controls for the pressure fluid in somewhat schematic form.

DESCRIPTION OF THE PREFERRED EMBODIMENTS

As shown on the drawing, the centrifuge drum includes a lower part 1 and an upper part 2 which are connected to each other by axially extending bolts 3, with these parts rotating in unison. Both parts together form a double cone shaped separating chamber 4 which is circularly symmetrical about the axis of rotation of the chamber. A distributor 5 with a packet of separating elements 6 is arranged within the chamber for performing the separation function. The materials to be separated are fed into the chamber to pass through the packet 6 from a feed pipe 7 which is centrally located above and which discharges centrally into the chamber.

The lower part 1 of the centrifuge drum is encircled by a concentric cylindrical valve 8 and by a guide ring 9 which guide ring is situated between the vertical annular wall of the sliding cylindrical valve, and the annular outer surface of the lower part 1. The ring 9 is of an elastomeric material such as rubber and simultaneously functions to seal the space between the wall of the slide valve 8 and the outer annular wall of the lower part 1 which enables the slide valve 8 to move up and down relative to the lower part 1.

The sliding cylindrical valve 8 has the annular outer wall part and a lower inwardly extending flange or floor 11 which is integral with the annular wall being connected thereto at 10.

The upper edge of the sliding valve coacts with the annular lower edge of the upper part 2 and together they form a gap $S_2$ through which separated heavy material is discharged from the chamber 4. The gap $S_2$ is shown opened for discharge on the left hand side of the drawing and is shown as closed on the right hand side of the drawing. At the lower annular edge of the upper part 4 and an insert such as a rubber gasket may be provided for sealingly receiving the upper annular edge of the slide valve 8.

The floor 11 of the sliding cylindrical valve is arranged to be axially movable on a hub 12 of the lower part 1 which is provided with an attached annular collar 13.

Between the floor 11 of the slide valve and the underside of the lower part 1 are positioned one or more springs 13' which springs are biased to exert a downward force against the floor 11 and thus urge the slide valve in a downward or an open direction.

Also between the floor 11 of the slide valve and the collar 13 is an annular pressure chamber 14. The pressure chamber is sealed by annular seals A which surround the collar 13 and by seals B which are positioned between the hub 12 of the lower part and the floor 11.

The annular pressure chamber 14 is supplied with pressurized fluid through passages 15 which extend radially outwardly and downwardly through the lower part 1. The bores 15 are supplied with pressurized fluid to an axial passage 16, and the passage 16 and the passages 15 together, are relatively large for admitting the flow of pressurized liquid or relieving the flow of pressurized liquid without a lag.

The drive shaft 17 which supports the separator drum is driven in rotation by a suitable means, not shown, and between the shaft 17 and a hydraulic pressure supply line 18 which connects to the passage 16, there is a rotary connector seal, not shown.

The hydraulic line 18 has a flow meter 19 therein. The flow meter is supplied through branch lines 30 and 40, and the supply to these lines is controlled by a control device which consists essentially of pilot valves 26 and 29 and a volume control element 31.

For supplying hydraulic liquid to the pressure chamber 14, a pressure pump is provided which receives liquid from a container 21 and delivers it through a line 22 which is connected to the pilot valve 26. The line 22 is connected with an adjustable maximum pressure valve 23, a meter 24 and a pressure reservoir 25. The pilot valve 26 in the valve position Zero which is represented in the drawing, connects the line 27 at the connection A with the return line 28.

In the valve position I, the pressure line 22 is connected with the connection A and thus with the line 27. The line 27 is connected to the pilot valve 29. In the case of the valve position Zero, for the valve 29, as shown on the drawing, the line 27 connects to the line 30 at the connection B. Line 30, of course, connects to the hydraulic line 18. In the valve position I of the valve 29, the lines 27 and 30 are blocked with respect to each other.

The volume control element 31 consists of a double operating piston and cylinder unit 32 and 33 with the piston having a piston rod 34 which is positioned to engage an adjustable stop 37. This limits the movement of the piston 33 in its movement to the right away from the end cap 35 of the cylinder. The other end of the cylinder is formed by the annular cap 36 which has suitable seals surrounding the piston rod 34.

The end position of the piston rod 34, which of course, controls the end travel of the piston 33, is determined by an end position caliper 38 which is arranged in the cylinder wall of the volume control element 31. The pressure chamber which is located between the piston 33 and the end cap 35 connects via line 39 with the line 27. The pressure chamber on the opposite side of the piston where the rod is connected, is connected via line 40 with the line 18.

In operation of the self-discharging solid jacket centrifuge, it can be further explained by reference to the different operating states or level settings.

Setting 1—Completely Opened Ring Slot

In this operating state, the pilot valves 26 and 29 are in the valve position Zero. These valves are operated by actuation magnets which in this stage are not connected, and the restoring springs of the valves will urge them to this position Zero.

In this position, the pressure chamber 14 which is connected via the passages 15 and 16 and lines 18, 30, 27 and 28 with a container 21 is without pressure, i.e., vented to drain.

The sliding cylindrical valve 8 is moved downward to its lowermost position by means of the springs 13 and this is augmented by the internal pressure which prevails in the separating chamber 4. This will open the gap $S_2$ to maximum. The maximum opening will be determined by the depth of the pressure chamber 14 or by stops provided for the slide valve. Because of the small volume of the pressure chamber 14 and the relatively large free cross section of the hydraulic passages, the movement of the sliding cylindrical valve and therefore the opening of the gap $S_2$ occurs in an extremely short time.

The separated heavier materials which are collected in the separating chamber and which exit out through the gap $S_2$ are collected in an annular surrounding housing which surrounds the centrifuge drum and which need not be shown herein in detail. With the action of the spring 13' moving the slide valve to its maximum open or maximum lower position, a complete removal of the material from the pressure chamber 14 and a complete discharge of the material in the chamber 4 through the open gap $S_2$ will result. This can be advantageously accomplished irrespective of the rotational speed of the separator and, in fact, can be accomplished at standstill. One advantage of this is that the functional capacity of the sliding cylindrical valve can be precisely tested before putting the apparatus into operation.

Setting 2—Gap Closed

The pilot valve 26 in this operating state is brought into the valve position I by means of connection or actuation of the valve magnets. Hydraulic pressurized fluid will then flow into the pressure chamber 14, and the sliding cylindrical valve will be moved upwardly in a fraction of a second with a minimal time delay, and will be moved a distance upward determined by the pressure which is admitted into the chamber 14. With full pressure admitted, the gap $S_2$ will be closed with the upper edge of the slide valve pressed against the lower edge of the part 2.

In operation, materials to be separated are fed into the centrifuge through the feed pipe 7 from above. The solid liquid mixture proceeds through the interior of the distributor 5 and is separated with the heavier materials passing to the outer periphery of the separating chamber 4. The liquid which has been freed of the heavier materials moves inward and upward in the axial direction of the centrifuge and is discharged to the outside through outlets which are present but are not shown in detail in the drawing. The liquid pressure which prevails in the separating chamber will exert a hydraulic force on the ring shaped annular inner sloping surface 8*a* of the sliding valve. This force urges the valve toward open position and provides a hydraulic force acting in opposition to the hydraulic force of the hydraulic liquid in the pressure chamber 14.

If for reasons of safety an automatic or self-acting emptying of the drum is desirable, this can be accomplished by setting the maximum pressure of the pressure release valve 23 so that it will automatically open due to the hydraulic pressure of the contents of the chamber 4 acting on the surface 8*a*. This assures that an overloading or an overstressing of the centrifugal drum is avoided.

In the event that a complete emptying of the drum chamber 4 is to be accomplished, this may be done by a release signal sent to the pilot valve 26. This will release the pressure of the fluid in the chamber 14 and with the operation of the spring 13', the discharge of the hydraulic liquid from chamber 14 is immediately effected, and the slide valve drops so that the gap $S_2$ immediately opens. Because of these features, the sliding cylindrical valve 8 cannot only be moved independently of the operating state of the centrifuge, it can be operated with essentially no time delay as may be required either in movement in the opening direction or the closing direction. The foregoing structure also provides for control of the layer thickness of the heavy materials or liquid which collect on the outer wall of the separating chamber 4. During normal operation, the position and the closing movement of the sliding cylindrical valve is effectively attained by the presence and pressure of the hydraulic fluid in the pressure reservoir which dampens surges and maintains a stable operating condition.

Setting 3—Gap Only Partially Open

In the case of the gap being closed, the pressure chambers of the volume control element 31 are filled or activated on both sides of the piston 33 via the lines 39 and 40 with pressurized hydraulic liquid. Because of the smaller area of the piston which is acted on by liquid on the piston rod side, the piston 33 will move to the right up against the stop 37 by a distance $S_1$ which distance is set by the setting of the stop 37. A partial opening of the gap is now attained by means of switching of the valve 29 into the valve position I, and the switching of the valve 26 into the valve position Zero. The pressure chamber to the left of the piston 33 between the piston and the cap 35 is connected via line 39 and the pilot valve 26 with a return line 28 and is thereby vented and is pressureless. The line 30 is blocked by means of the pilot valve 29, and the hydraulic pressure which prevails in the pressure chamber 14 acts via the lines 18 and 40 on the pressure chamber of the piston rod side of the piston. The piston 33 is thereby moved to the left up to the cap 35 by the amount of length $S_1$. The volume shift in the pressure chamber on the piston rod side of the piston 33 is replenished by means of the quantities of hydraulic liquid flowing after it from the pressure chamber 14. The sliding cylindrical valve 18 is moved downward by means of the spring 13' and by means of the inner pressure in the chamber 4 to open the gap $S_2$ an amount which is proportional to the level $S_1$ which is set on the volume control element 31.

An intentional partial emptying of the separating chamber 4 is attained by means of a renewed reversal of the valves which is accomplished by the end caliper 38 with a selectable short time delay. The pilot valves 26 and 28 are automatically brought into a position to accomplish the closing position of the slide valve 8.

Another possibility of discharge consists in keeping the gap $S_2$ opened only a slight extent over a long period of time whereby the gap is precisely large enough that the heavy materials which are separated in the chamber 4 will dam up in front of the gap and thereby permit only the allowable quantity in each case to exit through the gap.

The path $S_1$ on the volume control or volume dosing element 21 corresponds to the gap $S_2$ which can be advantageously determined by means of a pick-up device instead of the end position caliper 38. This makes possible a constant and particularly precise continuous combination of the gap width for the materials to be separated in each instance. Further, the movement of the sliding valve can be monitored and evaluated with the help of the flow meter 19. Also, the control device makes possible a precise determination of the pressure in the centrifuge drum.

The achievements and attainments of the invention are not limited to the preferred embodiments which are shown and described. For example, a centrifuge may be employed which has slots or bores instead of a gap. Further, other types of spring elements may be arranged in lieu of the elements 13'. The pilot valves 26 and 28 can be combined into a single pilot valve as will be apparent to those skilled in the art from the foregoing description.

I claim as my invention:

1. A solid bowl centrifuge for separating substances of varying densities such as solid liquid mixtures, the centrifuge having a rotatable separating vessel symmetrical about its axis with a circumferential annular discharge gap for the discharge of separated heavy substances, and an annular slide valve for controlling the size of the gap, said centrifuge comprising:

means defining a pressure chamber having an element connected to the slide valve for closing the gap responsive to pressure in the chamber;

a pressure line connected to an external closed hydraulic system operating independently of centrifugal force of the centrifuge controlling fluid directed into the pressure chamber to control said gap;

and spring means between the vessel and the slide valve biasing the valve in a direction for opening said gap against the action of said pressure chamber.

2. A self-discharging solid bowl centrifuge for separating substances of varying densities such as solid liquid mixtures constructed in accordance with claim 1, in which:

said pressure chamber annularly surrounding a central area lying close to the axis of rotation of the vessel and located between a lower portion of the annular slide valve and an extension forming a floor of the separating vessel.

3. A self-discharging solid bowl centrifuge for separating substances of varying densities such as solid liquid mixtures constructed in accordance with claim 1, in which:

said control device includes at least one on-off valve disposed in said line and includes a volume control element for the pressurized fluid with said volume control element and on-off valve being functionally interconnected.

4. A self-discharging solid bowl centrifuge for separating substances of varying densities such as solid liquid mixtures constructed in accordance with claim 3, wherein:

said volume control element includes a piston slide cylinder unit with the piston interacting at one side with an adjustable stop.

5. A self-discharging solid bowl centrifuge for separating substances of varying densities such as solid liquid mixtures constructed in accordance with claim 4, in which:

an end position sensor is included for sensing the position of the piston and disposed in the cylinder wall of the cylinder unit.

6. A solid bowl centrifuge for separating substances of varying densities such as solid liquid mixtures, the centrifuge having a rotatable separating vessel symmetrical about a central axis and having an annular valve surface coacting with an annular slide valve for controlling the size of a circumferential annular gap leading from said separating vessel, said slide valve having an annular wall and being symmetrical about the vessel axis with a lower inwardly extending flange mounted for rotation of the slide valve with the vessel, said centrifuge comprising:

means defining a pressure chamber having an element connected to the slide valve for moving the gap toward closed position responsive to pressure in the chamber;

an external closed hydraulic system independent of centrifugal force of the centrifuge for delivering pressurized fluid to said pressure chamber and for releasing pressure from said chamber;

and spring means urging the slide valve in the direction to open said gap.

7. A self-discharging solid bowl centrifuge for separating substances of varying densities such as solid liquid mixtures constructed in accordance with claim 6, and including:

a surface on said slide valve exposed to material in the separating vessel and positioned so that said material will urge the slide valve toward an open position.

8. A self-discharging solid bowl centrifuge for separating substances of varying densities such as solid liquid mixtures constructed in accordance with claim 7, wherein:

said surface is positioned radially inwardly of an annular valve surface on the slide valve.

9. A self-discharging solid bowl centrifuge for separating substances of varying densities such as solid liquid mixtures constructed in accordance with claim 6, wherein:

the pressure supply to the pressure chamber includes a rapidly opening relief valve.

10. A self-discharging solid bowl centrifuge for separating substances of varying densities such as solid liquid mixtures constructed in accordance with claim 6, wherein:

the pressure supply to the pressure chamber has means for delivering a presettable predetermined amount of hydraulic liquid to the pressure chamber.

11. A solid bowl centrifuge for separating substances of varying densities such as solid liquid mixtures, the centrifuge having a rotatable separating vessel symmetrical about its axis with a circumferential annular discharge gap for discharge of separated heavy substances, said centrifuge comprising:

an upper housing part having a lower annular valve edge;

an inlet leading into said upper part;

a lower housing part forming with the upper part a separation chamber;

a slide valve having an annular wall surrounding the lower housing part with an upper valve edge coacting with the lower edge of the upper housing part to form a discharge gap, said slide valve including an annular inwardly extending floor;

a drive shaft supporting the lower housing part;

means interconnecting the upper and lower housing part for simultaneous rotation;

spring biasing means between the lower part and the slide valve urging the slide valve in a direction to open said gap;

an annular hydraulic liquid pressure chamber between the lower housing part and the slide valve positioned to urge the slide valve in a direction to close the gap with the admission of hydraulic pressure;

fluid pressure passages leading through the shaft to the pressure chamber;

and an external closed hydraulic system independent of centrifugal force of the centrifuge leading to the passages of the shaft.

12. A self-discharging solid bowl centrifuge constructed in accordance with claim 11, wherein:

the liquid supply includes a fast release valve for dumping the fluid.

13. A self-discharging solid bowl centrifuge constructed in accordance with claim 11, wherein:

the liquid supply includes a dosing valve for delivering a measured adjustable amount of liquid to the pressure chamber.

14. A self-discharging solid bowl centrifuge constructed in accordance with claim 11, wherein:

said slide valve has an upwardly facing pressure reacting surface exposed to material in the housing and urging the slide valve in a direction to increase the discharge gap.

* * * * *